US011127337B2

(12) United States Patent
Jeong et al.

(10) Patent No.: US 11,127,337 B2
(45) Date of Patent: Sep. 21, 2021

(54) DATA DRIVING DEVICE FOR DRIVING PIXELS ARRANGED ON DISPLAY PANEL

(71) Applicant: SILICON WORKS CO., LTD., Daejeon (KR)

(72) Inventors: Min Young Jeong, Daejeon (KR); Yong Jung Kwon, Daejeon (KR); Ho Sung Hong, Daejeon (KR); Jung Bae Yun, Daejeon (KR); Jeung Hie Choi, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 16/755,345

(22) PCT Filed: Dec. 17, 2018

(86) PCT No.: PCT/KR2018/015972
§ 371 (c)(1),
(2) Date: Apr. 10, 2020

(87) PCT Pub. No.: WO2019/132347
PCT Pub. Date: Jul. 4, 2019

(65) Prior Publication Data

US 2020/0312218 A1 Oct. 1, 2020

(30) Foreign Application Priority Data

Dec. 27, 2017 (KR) ..... 10-2017-0180781

(51) Int. Cl.
*G09G 3/20* (2006.01)

(52) U.S. Cl.
CPC ... *G09G 3/2092* (2013.01); *G09G 2310/0275* (2013.01); *G09G 2310/0297* (2013.01)

(58) Field of Classification Search
CPC ..... G09G 3/2092; G09G 2310/0275; G09G 2310/0297; G09G 2370/08; G09G 2310/027; G09G 3/2096
See application file for complete search history.

(56) References Cited

U.S. PATENT DOCUMENTS 9,953,609 B2 4/2018 Kim et al.
2010/0149083 A1* 6/2010 Park ..... G09G 3/3611 345/99

(Continued)

FOREIGN PATENT DOCUMENTS

KR 10-2007-0055292 A 5/2007
KR 10-1341910 B1 12/2013

(Continued)

OTHER PUBLICATIONS

PCT International Search Report, PCT/KR2018/015972, dated Mar. 14, 2019, 4 Pages.

*Primary Examiner* — Andrew Sasinowski
(74) *Attorney, Agent, or Firm* — Fenwick & West LLP

(57) ABSTRACT

The present embodiment relates to a device for driving pixels arranged on a display panel, and a data driving device according to the present embodiment can transmit image data to a plurality of channel groups by including two or more mapping units for mapping the image data to a channel link or by using one data mapping unit connected to a plurality of multiplexers.

11 Claims, 8 Drawing Sheets

(56) References Cited

U.S. PATENT DOCUMENTS

| | | | | |
|---|---|---|---|---|
| 2011/0074745 | A1* | 3/2011 | Chang | G09G 3/20 345/204 |
| 2016/0125794 | A1* | 5/2016 | Park | G09G 3/2096 345/522 |
| 2016/0379588 | A1 | 12/2016 | Kim et al. | |
| 2017/0256192 | A1* | 9/2017 | Knepper | G09G 3/2092 |

FOREIGN PATENT DOCUMENTS

| | | | |
|---|---|---|---|
| KR | 10-2016-0078614 | A | 7/2016 |
| KR | 10-2017-0000897 | A | 1/2017 |
| KR | 10-2017-0071717 | A | 6/2017 |

* cited by examiner

DATA DRIVING DEVICE FOR DRIVING PIXELS ARRANGED ON DISPLAY PANEL

TECHNICAL FIELD

The present disclosure relates to technology for driving pixels arranged on a display panel.

BACKGROUND ART

A display panel comprises a plurality of pixels arranged in a form of a matrix. An image is formed on such a display panel when each of the plurality of pixels emits light with a greyscale value indicated by image data.

Image data may be transmitted from a data processing device, also referred to as a timing controller, to a data driving device, also referred to as a source driver. Image data is transmitted as a digital value and the data driving device may convert such a digital value into an analog voltage to drive each pixel.

The data driving device receives image data using serial communication. However, due to the space constraint between the data processing device and the data driving device, the number of wires that can be used for the serial communication is limited. On the contrary, the number of channels to transmit image data gradually increases because of a tendency that the resolution of a display panel becomes higher. Therefore, in a data driving device, a method of efficiently distributing image data received through a small number of serial communication wires to a plurality of channels would be an issue.

DETAILED DESCRIPTION OF THE INVENTION

Technical Problem

In this background, according to an aspect, the present disclosure is to provide a technique for efficiently distributing image data to a plurality of channels.

Technical Solution

To this end, an aspect of the present disclosure provides a data driving device for driving pixels arranged on a display panel.

Such a data driving device may comprise a data receiving circuit, a first data mapping circuit, a second data mapping circuit, and a plurality of groups of channels.

The data receiving circuit may receive image data through at least one communication link and distribute image data to transmit the image data to N (N is a natural number, which is 2 or higher) internal links.

The first data mapping circuit may receive first image data transmitted through first internal links among the internal links, map the first image data onto M1 (M1 is a natural number, which is 2 or higher) first channel links, and then transmit in parallel the first image data to the first channel links.

The second data mapping circuit may receive second image data transmitted through second internal links among the internal links, map the second image data onto M2 (M2 is a natural number, which is 2 or higher) second channel links, and then transmit in parallel the second image data to the second channel links.

The plurality of channel groups may be connected with one of the first channel links and the second channel links.

Each of the plurality of channel groups comprises a plurality of channels and each of the plurality of channels may sequentially receive image data transmitted through one channel link and drive a pixel using the received image data.

According to such an embodiment, the first data mapping circuit may comprise a storage circuit, and may store at least M1 pieces of data included in image data in the storage circuit and map M1 pieces of data out of the data stored in the storage circuit onto the first channel links to transmit them.

Here, data may be pixel data obtained by sectioning image data by pixel.

The data receiving circuit may further comprise a byte aligning circuit and a pixel aligning circuit. The byte aligning circuit may align image data by byte and the pixel aligning circuit may align image data by pixel.

The data receiving circuit may receive image data through at least one communication link for serial communication and perform a serial-parallel conversion of the image data to transmit it to internal links.

Each channel group may comprise channels having intervals of M1 or M2.

A plurality of first channel groups connected with the first channel links may be disposed in a first direction from the first data mapping circuit and a plurality of second channel groups connected with the second channel links may be disposed in a second direction from the second data mapping circuit. Here, the second direction is opposite the first direction.

Each channel may be connected to a data line extended in a third direction. The third direction may be perpendicular to the first and the second directions.

In addition, each channel may comprise a latch circuit, a digital-analog converter, and an output buffer. The latch circuit may latch image data from a channel link according to a first control timing signal, the digital-analog convertor may convert image data into a data voltage having an analog value according to a second control timing signal, the output buffer may supply the data voltage to a data line according to a third control timing signal.

Another aspect of the present disclosure provides a data driving device for driving pixels arranged on a display panel.

Such a data driving device may comprise a data receiving circuit, a first data mapping circuit, a plurality of multiplexers (MUXs), and a plurality of channel groups.

The data receiving circuit is connected, on one side, with at least one communication link through which image data is received and, on the other side, with first internal links through which image data is distributed.

The first data mapping circuit may be connected with first internal links and map image data received through the first internal links onto first channel links to transmit it.

The plurality of MUXs may be connected with the first channel links and control the output of image data received from the first channel links according to a control signal.

The plurality of channel groups may be connected with one of the plurality of MUXs.

Each of the plurality of channel groups may comprise a plurality of channels and each channel may sequentially receive image data transmitted through one MUX and drive a pixel using the received image data.

In this aspect of the present disclosure, the plurality of MUXs may output image data received from the first channel links to the channel groups respectively in different time sections.

The data driving device may further comprise a second data mapping circuit, which is connected with second internal links, maps image data received through the second internal links onto second channel links to transmit it. Here, the data receiving circuit may further be connected with the second internal links through which image data may be distributed and transmitted, and the plurality of MUXs may further be connected with the second channel links and selectively output image data received through the first channel links and the second channel links according to a control signal.

In a case when the data receiving circuit distributes image data to the first internal links and the second internal links, a first MUX may continuously transfer image data received through the first channel links to a first channel group and a second MUX may continuously transfer image data received through the second channel link to a second channel group.

Effects of the Invention

To this end, an aspect of the present disclosure provides a data driving device for driving pixels arranged on a display panel.

Such a data driving device may comprise a data receiving circuit, a first data mapping circuit, a second data mapping circuit, and a plurality of groups of channels.

The data receiving circuit may receive image data through at least one communication link and distribute image data to transmit the image data to N (N is a natural number, which is 2 or higher) internal links.

The first data mapping circuit may receive first image data transmitted through first internal links among the internal links, map the first image data onto M1 (M1 is a natural number, which is 2 or higher) first channel links, and then transmit in parallel the first image data to the first channel links.

The second data mapping circuit may receive second image data transmitted through second internal links among the internal links, map the second image data onto M2 (M2 is a natural number, which is 2 or higher) second channel links, and then transmit in parallel the second image data to the second channel links.

The plurality of channel groups may be connected with one of the first channel links and the second channel links. Each of the plurality of channel groups comprises a plurality of channels and each of the plurality of channels may sequentially receive image data transmitted through one channel link and drive a pixel using the received image data.

According to such an embodiment, the first data mapping circuit may comprise a storage circuit, and may store at least M1 pieces of data included in image data in the storage circuit and map M1 pieces of data out of the data stored in the storage circuit onto the first channel links to transmit them.

Here, data may be pixel data obtained by sectioning image data by pixel.

The data receiving circuit may further comprise a byte aligning circuit and a pixel aligning circuit. The byte aligning circuit may align image data by byte and the pixel aligning circuit may align image data by pixel.

The data receiving circuit may receive image data through at least one communication link for serial communication and perform a serial-parallel conversion of the image data to transmit it to internal links.

Each channel group may comprise channels having intervals of M1 or M2.

A plurality of first channel groups connected with the first channel links may be disposed in a first direction from the first data mapping circuit and a plurality of second channel groups connected with the second channel links may be disposed in a second direction from the second data mapping circuit. Here, the second direction is opposite the first direction.

Each channel may be connected to a data line extended in a third direction. The third direction may be perpendicular to the first and the second directions.

In addition, each channel may comprise a latch circuit, a digital-analog converter, and an output buffer. The latch circuit may latch image data from a channel link according to a first control timing signal, the digital-analog convertor may convert image data into a data voltage having an analog value according to a second control timing signal, the output buffer may supply the data voltage to a data line according to a third control timing signal.

Another aspect of the present disclosure provides a data driving device for driving pixels arranged on a display panel.

Such a data driving device may comprise a data receiving circuit, a first data mapping circuit, a plurality of multiplexers (MUXs), and a plurality of channel groups.

The data receiving circuit is connected, on one side, with at least one communication link through which image data is received and, on the other side, with first internal links through which image data is distributed.

The first data mapping circuit may be connected with first internal links and map image data received through the first internal links onto first channel links to transmit it.

The plurality of MUXs may be connected with the first channel links and control the output of image data received from the first channel links according to a control signal.

The plurality of channel groups may be connected with one of the plurality of MUXs.

Each of the plurality of channel groups may comprise a plurality of channels and each channel may sequentially receive image data transmitted through one MUX and drive a pixel using the received image data.

In this aspect of the present disclosure, the plurality of MUXs may output image data received from the first channel links to the channel groups respectively in different time sections.

The data driving device may further comprise a second data mapping circuit, which is connected with second internal links, maps image data received through the second internal links onto second channel links to transmit it. Here, the data receiving circuit may further be connected with the second internal links through which image data may be distributed and transmitted, and the plurality of MUXs may further be connected with the second channel links and selectively output image data received through the first channel links and the second channel links according to a control signal.

In a case when the data receiving circuit distributes image data to the first internal links and the second internal links, a first MUX may continuously transfer image data received through the first channel links to a first channel group and a second MUX may continuously transfer image data received through the second channel link to a second channel group.

MODE FOR IMPLEMENTING THE INVENTION

Figure 1:
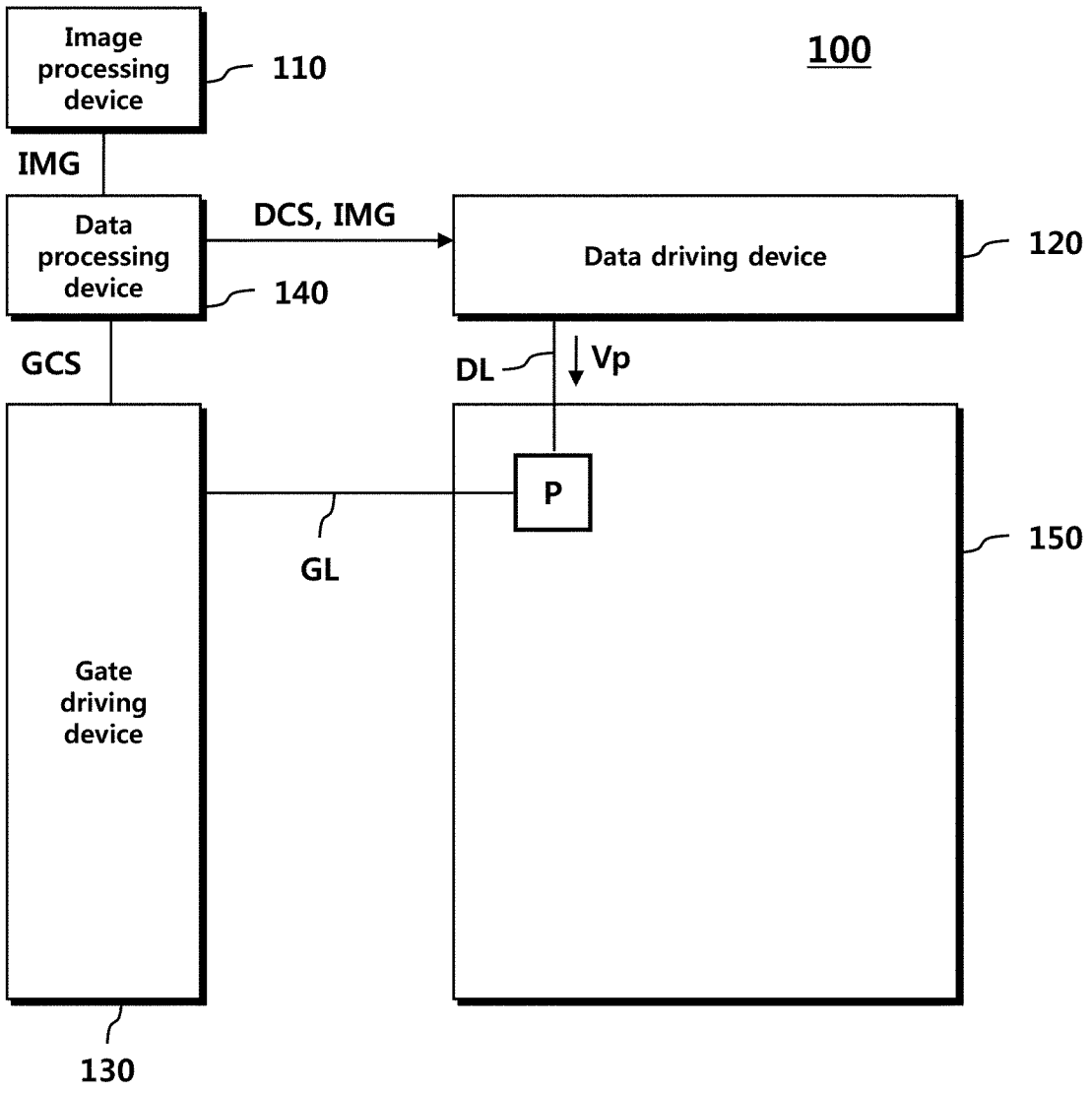
FIG. 1 is a configuration diagram of a display device according to an embodiment.

Hereinafter, some embodiments of the present disclosure will be described in detail with reference to the accompanying drawings. With regard to reference numerals of the components of the respective drawings, it should be noted that the same reference numerals are assigned to the same components even though they are shown in different drawings. In addition, in describing the present disclosure, a detailed description of a well-known configuration or function related the present disclosure, which may obscure the subject matter of the present disclosure, will be omitted.

In addition, terms, such as "1st", "2nd", "A", "B", "(a)", "(b)", or the like, may be used in describing the components of the present disclosure. These terms are intended only for distinguishing a corresponding component from other components, and the nature, order, or sequence of the corresponding component is not limited to the terms. In the case where a component is described as being "coupled", "combined", or "connected" to another component, it should be understood that the corresponding component may be directly coupled or connected to another component or that the corresponding component may also be "coupled", "combined", or "connected" to the component via another component provided therebetween.

FIG. 1 is a configuration diagram of a display device according to an embodiment.

Referring to FIG. 1, a display device 100 may comprise a plurality of display panel driving devices 110, 120, 130, 140 and a display panel 150.

On the display panel 150, a plurality of data lines DL, a plurality of gate lines GL, and a plurality of pixels P connected with the plurality of data lines DL and the plurality of gate lines GL may be arranged.

The display panel driving devices 110, 120, 130, 140 are to generate signals for displaying images on the display panel 150. An image processing device 110, a data driving device 120, a gate driving device 130, and data processing device 140 may correspond to the display panel driving device 110, 120, 130, 140.

The gate driving device 130 may supply gate driving signals, such as turn-on voltages or turn-off voltages, through the gate lines GL. When a gate driving signal of a turn-on voltage is supplied to a pixel P, the pixel P is connected with a data line DL. When a gate driving signal of a turn-off voltage is supplied to a pixel P, the pixel P is disconnected from the data line DL. The gate driving device 130 may be referred to as a gate driver.

The data driving device 120 may supply a data voltage Vp to a pixel P through a data line DL. The data voltage Vp supplied through the data line DL may be supplied to the pixel P according to a gate driving signal. The data driving device 120 may be referred to as a source driver.

The data processing device 140 may supply control signals to the gate driving device 130 and the data driving device 120 and transmit image data IMG to the data driving device 120. For example, the data processing device 140 may transmit a gate control signal GCS making a scan to start to the gate driving device 130. In addition, the data processing device 140 may transmit a data control signal DSC for controlling the data driving device 120 to supply a data voltage Vp to each pixel P. The data processing device 140 may be referred to as a timing controller.

The image processing device 110 may generate image data IMG and transmit it to the data processing device 140. The image processing device 110 may be referred to as a host.

Between the data processing device 140 and the data driving device 120, a serial communication interface is formed. The data processing device 140 may transmit data control signals DCS and/or image data IMG to the data driving device 120 through such a serial communication interface.

Figure 2:
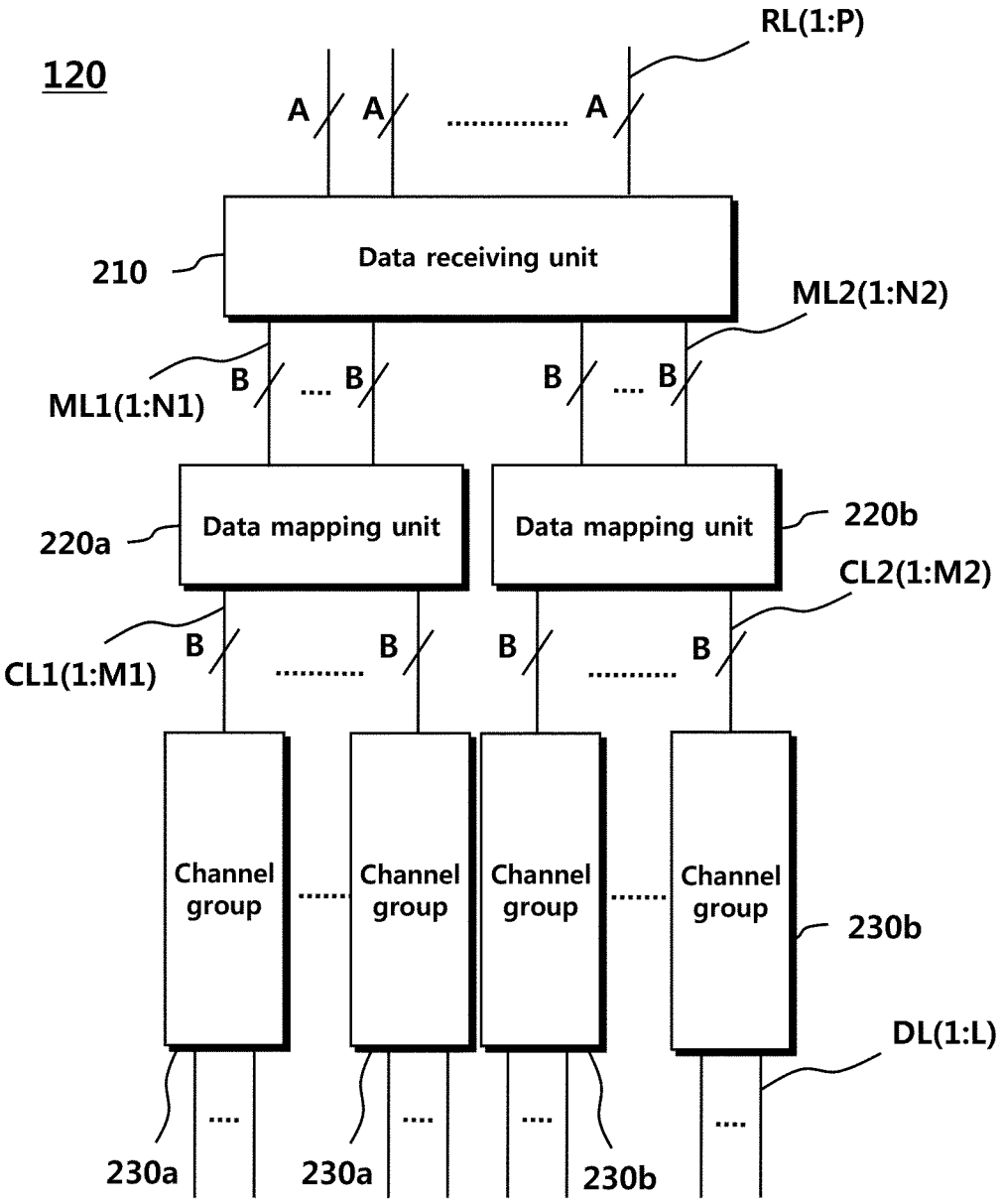
FIG. 2 is a configuration diagram of a data driving device according to an embodiment.

FIG. 2 is a configuration diagram of a data driving device according to an embodiment.

Referring to FIG. 2, the data driving device 120 may comprise a data receiving circuit 210, a plurality of data mapping circuits 220*a*, 22*b*, and a plurality of channel groups 230*a*, 230*b*.

The data receiving circuit 210 may be connected with P (P is a natural number) communication links RL on its one side and with N (N is a natural number, which is 2 or higher) internal links (ML1, ML2) on its other side. The data receiving circuit 210 may receive image data from the data processing device through the P communication links RL. In addition, the data receiving circuit 210 may distribute the received image data through the N internal links ML1, ML2 to transmit it to the plurality of data mapping circuits 220*a*, 220*b*.

Each communication link RL may comprise A (A is a natural number) wires. In a case when the communication link RL transmits and receives image data in a differential method, one communication link RL may comprise two wires.

Each of the internal links ML1, ML2 may comprise B (B is a natural number) wires. The number of wires B may be determined depending on the number of bits composing a byte. For example, in a case when a byte of image data consists of 10 bits, an internal link ML1, ML2 may comprise 10 wires. The number of wires B of a channel link CL1, CL2 to be described below may be determined in the same way.

The plurality of data mapping circuits 220*a*, 220*b* may be connected with the N internal links ML1, ML2 and with M (M is a natural number, which is 2 or higher) channel links CL1, CL2. The plurality of data mapping circuits 220*a*, 22*b* may receive image data through the N internal links ML1, ML2 and transmit the received image data by mapping it onto the M (M is a natural number, which is 2 or higher) channel links CL1, CL2.

The internal links ML1, ML2 may comprise N1 (N1 is a natural number) first internal links ML1 and N2 (N2 is a natural number) second internal links. The first internal links ML1 may be connected with a first data mapping circuit 220*a* and the second internal links ML2 may be connected with a second data mapping circuit 220*b*. Here, the sum of N1 and N2 may be equal to N.

The first data mapping circuit 220*a* may receive first image data transmitted through the first internal links ML1 and map the first image data onto M1 (M1 is a natural number, which is 2 or higher) first channel links CL1. In addition, the first data mapping circuit 220*a* may in parallel or simultaneously transmit the first image data mapped onto the M1 first channel links CL1.

The second data mapping circuit 220*b* may receive second image data transmitted through the second internal links ML2 and map the second image data onto M2 (M2 is a natural number, which is 2 or higher) second channel links CL2. In addition, the second data mapping circuit 220*b* may in parallel or simultaneously transmit the second image data mapped onto the M2 second channel links CL2. Here, the sum of M1 and M2 may be equal to M.

The plurality of channel groups 230*a*, 230*b* may be connected with the M channel links CL1, CL2. Each of the plurality of channel groups 230*a*, 230*b* may be connected with one CL1, CL2 of the M channel links CL1, CL2.

Each of the channel groups 230*a*, 230*b* may comprise a plurality of channels. The plurality of channels composing a channel group 230*a*, 230*b* may share one channel link CL1, CL2 and sequentially receive image data transmitted through the one channel link CL1, CL2.

One data driving device 120 may be connected with L (L is a natural number, which is 2 or higher) data lines DL and each channel may be connected with one data line DL.

Each channel may receive image data, convert the image data into a data voltage, and supply the data voltage through a data line DL. A data voltage is an analog voltage indicating a greyscale of a pixel. Each pixel may be controlled in its greyscale according to the data voltage.

The plurality of channels composing one channel group 230*a*, 230*b* may share one channel link CL1, CL2. The plurality of channels may sequentially receive image data through the one channel link CL1, CL2. For example, in a case when one channel group 230*a*, 230*b* comprises 4 channels, image data regarding 4 pixels may sequentially be transmitted through the one channel link CL1, CL2, and each channel may sequentially latch image data corresponding to itself out of image data transmitted through the one channel link CL1, CL2.

The number Q of channels composing one channel group 230*a*, 230*b* may be determined by the number M of channel links CL1, CL2 and the number L of data lines DL as shown in an equation 1 described below.

$$\text{The number } Q \text{ of channels} = \text{The number of } L \text{ of data lines} / \text{The number } M \text{ of channel links} \quad \text{[Equation 1]}$$

Figure 3:
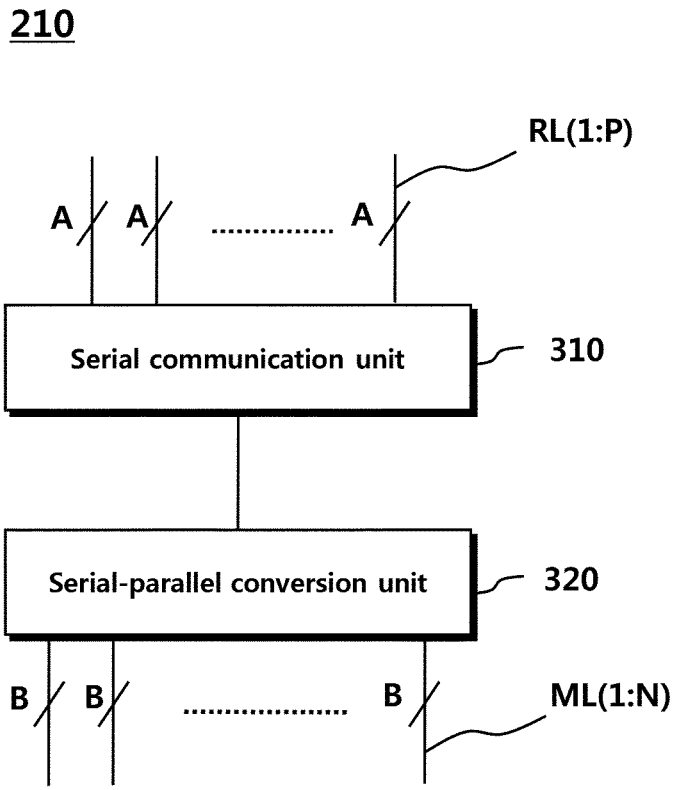
FIG. 3 is a configuration diagram of a data receiving circuit according to an embodiment.

FIG. 3 is a configuration diagram of a data receiving circuit according to an embodiment.

Referring to FIG. 3, the data receiving circuit 210 may comprise a serial communication circuit 310 and a serial-parallel conversion circuit 320.

The serial communication circuit 310 may be connected with at least one communication link RL and receive image data through the at least one communication link RL.

The serial communication circuit 310 may receive image data using serial communication. In a case when the serial communication is performed in a differential way, each communication link RL may comprise two wires.

The serial communication circuit 310 may further receive a clock signal from the data processing device and train an internal clock in accordance with the clock signal.

The clock signal may be received together with image data through a communication link RL. Such a clock signal may be referred to as an embedded clock.

A clock signal may be received through a separate wire. The serial communication circuit 310 may train an internal clock in accordance with the clock signal received through the separate wire.

The serial-parallel conversion circuit 320 may perform a serial-parallel conversion of image data received using the serial communication and transmit it to internal links ML.

Although they are not shown in the drawings, the data receiving circuit 210 may further comprise a byte aligning circuit, a pixel aligning circuit, and a decoder. The byte aligning circuit may, for example, align image data by byte so that a subsequent element, for example, a data mapping circuit may read the image data sectioned by byte. The pixel aligning circuit may, for example, align image data by pixel, for example R (red), G (green), B (blue), so that a subsequent element, for example, a data mapping circuit may read the image data sectioned by pixel. The data processing device may transmit image data in an encoded state. The encoded image data may be decoded by the decoder comprised in the data receiving circuit.

Figure 4:
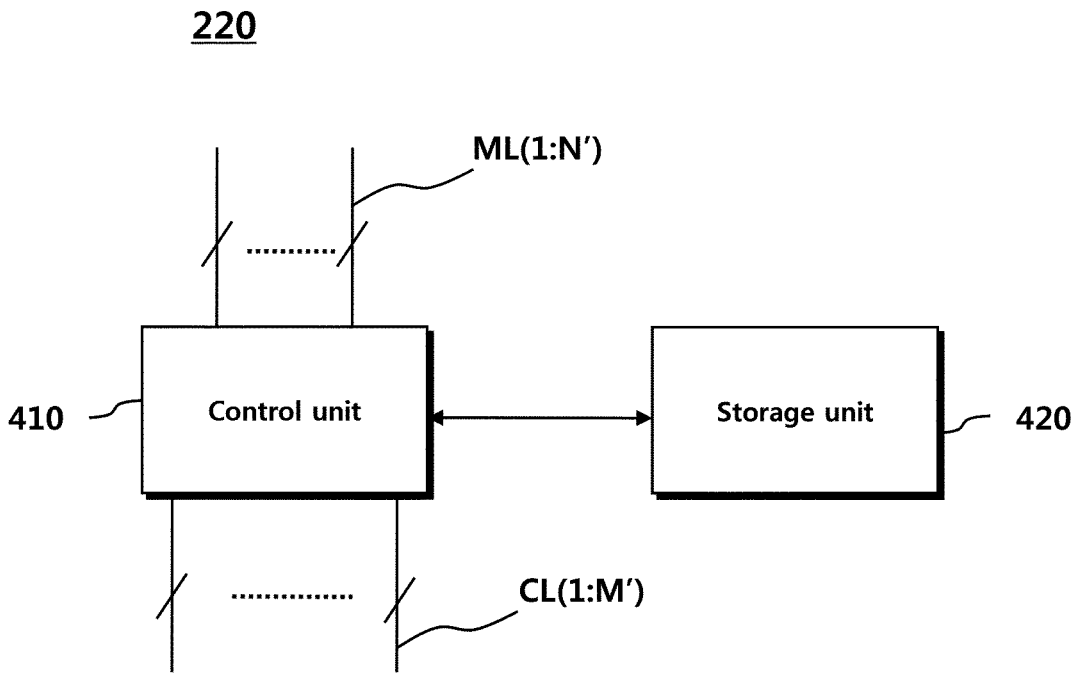
FIG. 4 is a configuration diagram of a data mapping circuit according to an embodiment.

FIG. 4 is a configuration diagram of a data mapping circuit according to an embodiment.

Referring to FIG. 4, a data mapping circuit 220 may comprise a control circuit 410 and a storage circuit 420.

The control circuit 410 may receive image data through N' (N' is a natural number, such as N1, N2, and so on) internal links ML, map it onto M' (M' is a natural number, such as M1, M2, and so on) channel links CL, and transmit it in parallel.

In a case when the number N' of the internal links ML through which image data is received is equal to the number M' of the channel links CL through which image data is transmitted, a module for storing image data is not necessary depending on embodiments. However, in a case when the number N' of the internal links ML is different from the number M' of the channel links CL, the data mapping circuit 220 may comprise a storage circuit 420 for mapping image data.

The storage circuit 420 may store at least M' pieces of data. Here, the data may be pixel data obtained by sectioning image data by pixel. The pixel data may comprise a greyscale value corresponding each pixel.

The control circuit 410 may map the M' pieces of data stored in the storage circuit 420 onto the channel links CL and transmit them.

The control circuit 410 may simultaneously transmit the M' pieces of data through the channel links CL. The control circuit 410 may simultaneously transmit the M' pieces of data stored in the storage circuit 420 through the channel links CL by predetermined periods.

Figure 5:
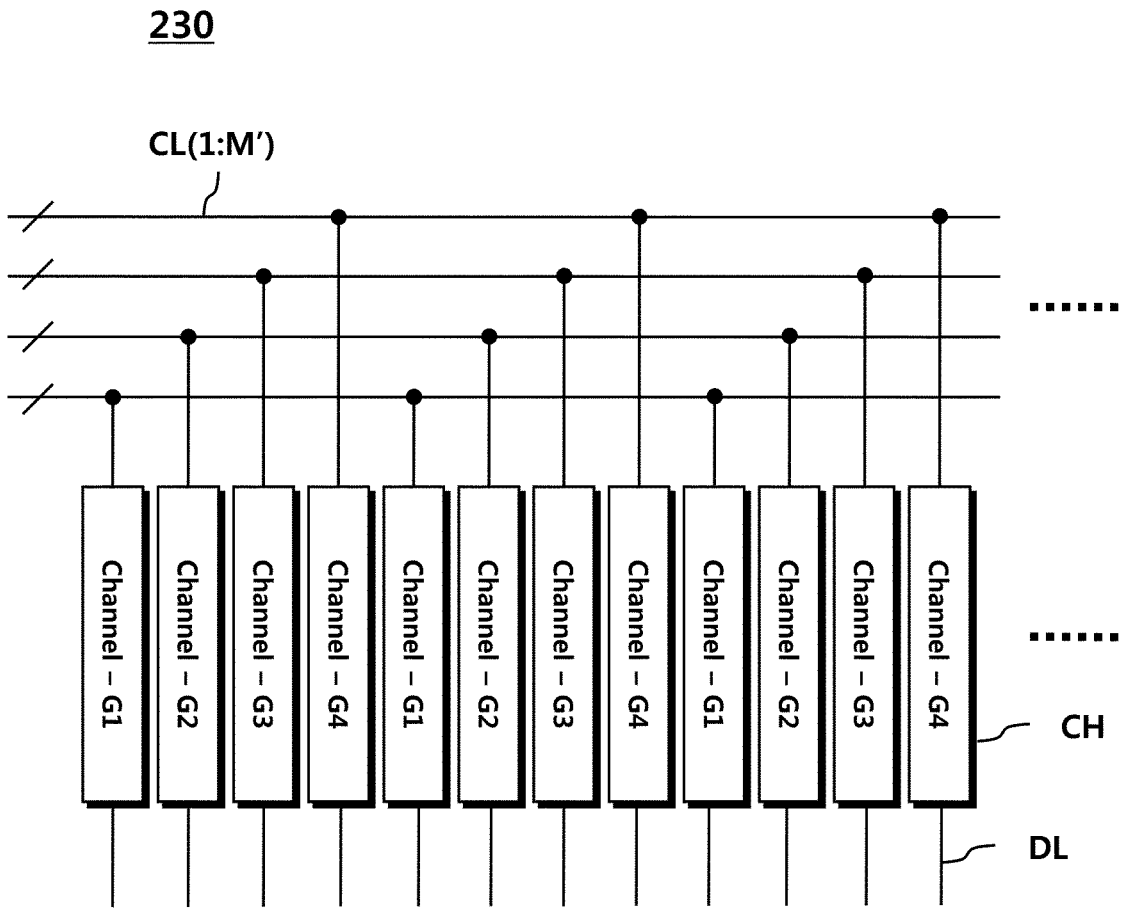
FIG. 5 is a configuration diagram of channel groups according to an embodiment.

FIG. 5 is a configuration diagram of channel groups according to an embodiment.

Referring to FIG. 5, each of channel groups G1, G2, G3, G4 may comprise a plurality of channels CH. The plurality of channels CH composing each channel group G1, G2, G3, G4 may have intervals of the number M' (for example, M1, M2, etc.) of the channel links CL. For example, in a case when the number M' of the channel links CL is 4, the channels CH belonging to a first channel group G1 may be the first, fifth, and ninth in the sequence. The channels CH belonging to a second group G2 may be the second, sixth, and tenth in the sequence, the channels CH belonging to a third channel group G3 may be the third, seventh, and eleventh in the sequence, and the channels CH belonging to a fourth channel group G4 may be the fourth, eighth, and twelfth in the sequence. Each of the channel groups G1, G2, G3, G4 is connected with a channel link CL different from others and the plurality of channels CH composing each of the channel groups G1, G2, G3, G4 are connected with the same one channel link CL, thereby sequentially receiving image data transmitted through the channel link CL. For example, a channel CH of the first channel group G1 disposed in the first of the sequence latches image data at a first time point, a channel CH disposed in the fifth of the sequence latches image data at a second time point, and so on. In such a way, each channel CH may latch image data.

Each channel CH may comprise a latch circuit, a digital-analog converter, an output buffer. The latch circuit may latch image data from a channel link CL according to a first control timing signal. In addition, the latch circuit may transfer the image data to the digital-analog converter according to a second control timing signal. The digital-analog converter may convert the image data having a digital value into a data voltage having an analog value. The output buffer may supply the data voltage to a data line DL according to a third control timing signal.

Figure 6:
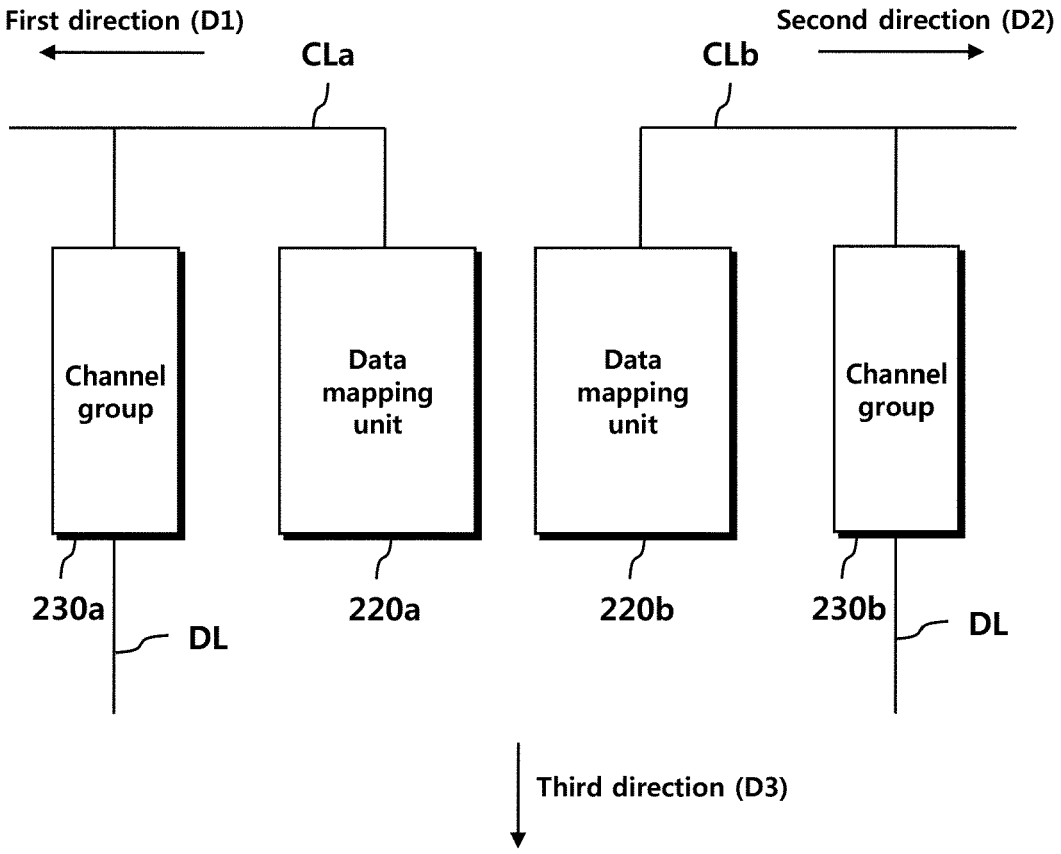
FIG. 6 is a diagram showing disposition directions of channel links according to an embodiment.

FIG. 6 is a diagram showing disposition directions of channel links according to an embodiment.

Referring to FIG. 6, a first channel group 230*a* connected with a first channel link CLa may be disposed in a first direction D1 from the first data mapping circuit 220*a*. A second channel group 230*b* connected with a second channel link CLb may be disposed in a second direction D2 from the second data mapping circuit 220*b*.

The second direction D2 may be opposite the first direction D1. For example, the second direction D2 may be the right and the first direction D1 may be the left. The first direction D1 and the second direction D2 may be perpendicular to a third direction D3. A data line DL may be extended in the third direction D3.

Figure 7:
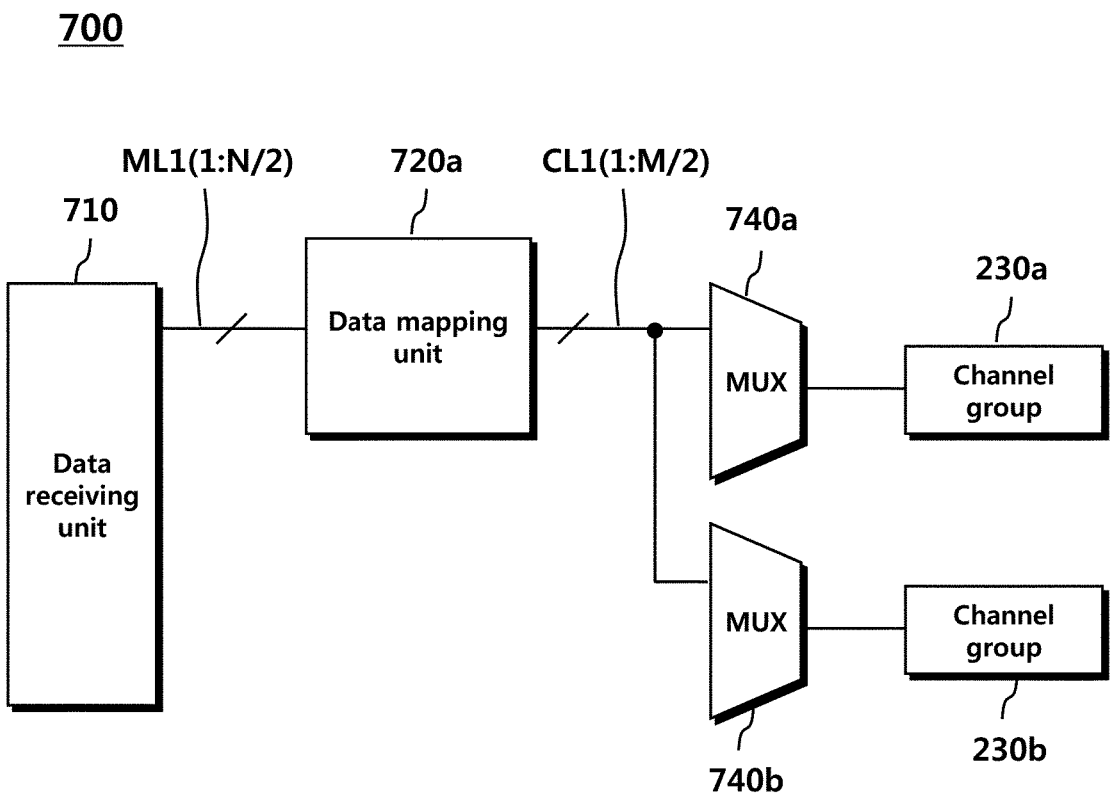
FIG. 7 is a configuration diagram of a first example of a data driving device according to another embodiment.

FIG. 7 is a configuration diagram of a first example of a data driving device according to another embodiment.

Referring to FIG. 7, a data driving device 700 may comprise a data receiving circuit 710, a first data mapping circuit 720*a*, a plurality of MUXs 740*a*, 740*b*, and a plurality of channel groups 230*a*, 230*b*.

The data receiving circuit 710 may be connected with at least one communication link through which image data is received and with first internal links ML1 through which the received image data is distributed to be transmitted. The data receiving circuit 710 may be connected with N/2 (N is an even number, which is 2 or higher) first internal links ML1.

The first data mapping circuit 720*a* may be connected with the first internal links ML1 and map image data received through the first internal links ML1 onto first channel links CL1 to transmit the image data. The first data mapping circuit 720*a* may be connected with M/2 (M is an even number, which is 2 or higher) first channel links CL1.

The plurality of MUXs 740*a*, 740*b* may be connected with the first channel links CL1 and control the output—the on-off ON/OFF of the output—of image data received through the first channel links CL1. For example, when a first control signal is transmitted to a first MUX 740*a* at a first time point, the first MUX 740*a* may transfer image data received through the first channel links CL1 to a first channel group 230*a*. When a second control signal is transmitted to a second MUX 740*b* at a second time point, the second MUX 740*b* may transfer image data received through second channel links CL2 to a second channel group 230*b*.

The plurality of MUXs 740*a*, 740*b* may output image data received through the first channel links CL1 respectively in different time sections.

The first MUX 740*a* and the second MUX 740*b* may transfer image data received through the first channel links CL1 to the channel groups 230*a*, 230*b* respectively in different time sections. For example, in a time section where the first MUX 740*a* transfers image data received through the first channel links CL1 to the first channel group 230*a*, the second MUX 740*b* may not transfer image data received through the first channel links CL1 to the second channel group 230*b*, and in a time section where the second MUX 740*b* transfers image data received through the first channel links CL1 to the second channel group 230*b*, the first MUX 740*a* may not transfer image data received through the first channel links CL1 to the first channel group 230*a*.

Each of the channel groups 230*a*, 230*b* may be connected with one of the plurality of MUXs 740*a*, 740*b*. Each of the channel groups 230*a*, 230*b* may comprise a plurality of channels and each channel may sequentially receive image data transmitted through one of the MUXs 740*a*, 740*b* and drive a pixel using the received image data.

Figure 8:
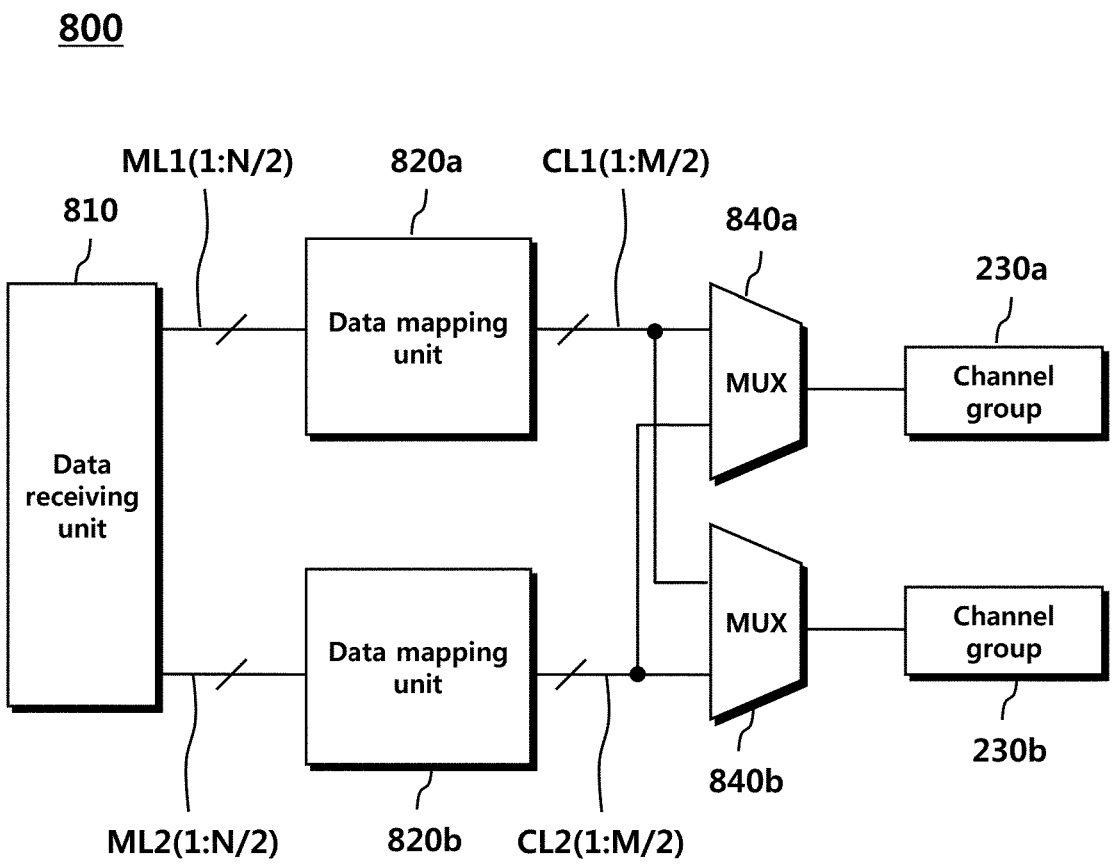
FIG. 8 is a configuration diagram of a second example of a data driving device according to another embodiment.

FIG. 8 is a configuration diagram of a second example of a data driving device according to another embodiment.

Referring to FIG. 8, a data driving device 800 may comprise a data receiving circuit 810, a plurality of data mapping circuits 820*a*, 820*b*, a plurality of MUXs 840*a*, 840*b*, and a plurality of channel groups 230*a*, 230*b*.

The data receiving circuit 810 may be connected with at least one communication link through which image data is received, and with first internal links ML1 and second internal links ML2 through which the received image data is distributed to be transmitted. The data receiving circuit 810 may be connected with N/2 (N is an even number, which is 2 or higher) first internal links ML1 and with N/2 (N is an even number, which is 2 or higher) second internal links ML2.

A first data mapping circuit 820*a* may be connected with the first internal links ML1 and map image data received through the first internal links ML1 onto first channel links CL1 to transmit the image data. The first data mapping circuit 820*a* may be connected with M/2 (M is an even number, which is 2 or higher) first channel links CL1.

A second data mapping circuit 820*b* may be connected with second internal links ML2 and map image data received through the second internal links ML2 onto second channel links CL2 to transmit the image data. The second data mapping circuit 820*b* may be connected with M/2 (M is an even number, which is 2 or higher) second channel links CL2.

The plurality of MUXs 840*a*, 840*b* may be connected with the first channel links CL1 and the second channel links CL2 and control the output of image data, that is, selectively output the image data received through the first channel links CL1 and the second channel links CL2.

For example, the first MUX 740*a* may transfer image data transmitted through the first channel links CL1 to a first channel group 230*a* according to a first control signal and transfer image data transmitted through the second channel links CL2 to the first channel group 230 according to a second control signal. The second MUX 740*b* may transfer image data transmitted through the first channel links CL1 to a second channel group 230*b* according to the first control signal and transfer image data transmitted through the second channel links CL2 to the second channel group 230*b* according to the second control signal.

In a case when the data receiving circuit 810 transmits image data by distributing it through the first internal links ML1 and the second internal links ML2, the first MUX 840*a* may continuously transfer image data received through the first channel links CL1 to the first channel group 230*a* and the second MUX 840*b* may continuously transfer image data received through the second channel links CL2 to the second channel group 230*b*. Here, the first control signal may be supplied to the first MUX 840*a* and the second control signal may be supplied to the second MUX 840*b*.

On the other hand, in a case when the data receiving circuit 810 transmits image data only through the first internal links ML1, the first MUX 840*a* and the second MUX 840*b* may alternately transmit image data received through the first channel links CL1 respectively to the first channel group 230*a* and the second channel group 230*b*.

As described above, according to the present disclosure, a data driving device may efficiently distribute image data to a plurality of channels.

Since terms, such as "including," "comprising," and "having" mean that corresponding elements may exist unless they are specifically described to the contrary, it shall be construed that other elements can be additionally included, rather than that such elements are omitted. All technical, scientific or other terms are used consistently with the meanings as understood by a person skilled in the art unless defined to the contrary. Common terms as found in dictionaries should be interpreted in the context of the related technical writings, rather than overly ideally or impractically, unless the present disclosure expressly defines them so.

Although a preferred embodiment of the present disclosure has been described for illustrative purposes, those skilled in the art will appreciate that various modifications, additions and substitutions are possible, without departing from the scope and spirit of the embodiment as disclosed in the accompanying claims. Therefore, the embodiments disclosed in the present disclosure are intended to illustrate the scope of the technical idea of the present disclosure, and the scope of the present disclosure is not limited by the embodiment. The scope of the present disclosure shall be construed on the basis of the accompanying claims in such a manner that all of the technical ideas included within the scope equivalent to the claims belong to the present disclosure.

What is claimed is:

1. A data driving device for driving pixels arranged on a display panel, comprising:

a data receiving circuit to receive image data through one communication link and to distribute the image data to transmit it through N (N is a natural number, which is 2 or higher) internal links;

a first data mapping circuit to receive first image data through first internal links among the internal links and to map the first image data onto M1 (M1 is a natural number, which is 2 or higher) first channel links to transmit it in parallel;

a second data mapping circuit to receive second image data through second internal links among the internal links and to map the second image data onto M2 (M2 is a natural number, which is 2 or higher) second channel links to transmit it in parallel; and a plurality of channel groups connected with one channel link of the first channel links and the second channel links, wherein each channel group comprises a plurality of channels and each channel sequentially receives the image data transmitted through the one channel link and drives a pixel using received image data, wherein the first data mapping circuit comprises a storage circuit, stores M1 pieces of data included in the image data in the storage circuit, and maps the M1 pieces of the data stored in the storage circuit respectively onto the first channel links and transmit them, wherein the data is pixel data obtained by sectioning the image data by pixel, wherein the data receiving circuit further comprises a byte aligning circuit and a pixel aligning circuit, wherein the byte aligning circuit aligns the image data by byte and the pixel aligning circuit aligns the image data by pixel.

2. The data driving device of claim 1, wherein the data receiving circuit receives the image data through the one communication link for serial communication, performs a serial-parallel conversion of the image data, and transmits the image data though the internal links.

3. The data driving device of claim 1, wherein each channel group comprises channels having intervals of M1 or M2.

4. The data driving device of claim 1, wherein each channel comprises a latch circuit, a digital-analog converter, and an output buffer, wherein the latch circuit latches the image data from a channel link according to a first control timing signal, the digital-analog converter converts the image data into a data voltage having an analog value according to a second control timing signal, and the output buffer supplies the data voltage to a data line according to a third control timing signal.

5. A data driving device for driving pixels arranged on a display panel, comprising:

a data receiving circuit to receive image data through one communication link and to distribute the image data to transmit it through N (N is a natural number, which is 2 or higher) internal links;

a first data mapping circuit to receive first image data through first internal links among the internal links and to map the first image data onto M1 (M1 is a natural number, which is 2 or higher) first channel links to transmit it in parallel;

a second data mapping circuit to receive second image data through second internal links among the internal links and to map the second image data onto M2 (M2 is a natural number, which is 2 or higher) second channel links to transmit it in parallel; and a plurality of channel groups connected with one channel link of the first channel links and the second channel links, wherein each channel group comprises a plurality of channels and each channel sequentially receives the image data transmitted through the one channel link and drives a pixel using received image data, wherein a plurality of first channel groups connected with the first channel links are disposed in a first direction from the first data mapping circuit, and a plurality of second channel groups connected with the second channel links are disposed in a second direction from the second data mapping circuit, wherein the second direction is opposite the first direction.

6. The data driving device of claim 5, wherein each channel is connected with a data line extended in a third direction, wherein the first direction and the second direction are perpendicular to the third direction.

7. A data driving device for driving pixels arranged on a display panel, comprising:

a data receiving circuit to receive image data through one communication link and to distribute the image data to transmit it through N (N is a natural number, which is 2 or higher) internal links;

a first data mapping circuit to receive first image data through first internal links among the internal links and to map the first image data onto M1 (M1 is a natural number, which is 2 or higher) first channel links to transmit it in parallel;

a second data mapping circuit to receive second image data through second internal links among the internal links and to map the second image data onto M2 (M2 is a natural number, which is 2 or higher) second channel links to transmit it in parallel; and a plurality of channel groups connected with one channel link of the first channel links and the second channel links, wherein each channel group comprises a plurality of channels and each channel sequentially receives the image data transmitted through the one channel link and drives a pixel using received image data, wherein each channel comprises a latch circuit, a digital-analog converter, and an output buffer, wherein the latch circuit latches the image data from a channel link according to a first control timing signal, the digital-analog converter converts the image data into a data voltage having an analog value according to a second control timing signal, and the output buffer supplies the data voltage to a data line according to a third control timing signal.

8. A data driving device for driving pixels arranged on a display panel, comprising:

a data receiving circuit connected, on one side, with one communication link through which image data is received and, on the other side, with first internal links through which the image data is distributed to be transmitted;

a first data mapping circuit connected with the first internal links and to map the image data received through the first internal links onto first channel links to transmit the image data;

a plurality of MUXs connected with the first channel links and to control the output of the image data received through the first channel links according to a control signal; and a plurality of channel groups connected with one of the plurality of MUXs, wherein each of the plurality of channel groups comprises a plurality of channels and each channel sequentially receives the image data transmitted through the one of the plurality of MUXs and drives a pixel using received image data.

9. The data driving device of claim 8, wherein the plurality of MUXs output the image data received through the first channel links to the channel groups respectively in different time sections.

10. The data driving device of claim 8 further comprising a second data mapping circuit connected with second internal links and to map the image data received through the second internal links onto second channel links to transmit the image data; wherein the data receiving circuit is further connected with the second internal links through which the image data is distributed to be transmitted, the plurality of MUXs are further connected with the second channel links and selectively outputs the image data received through the first channel links and the second channel links according to the control signal.

11. The data driving device of claim 10, wherein, in a case when the data receiving circuit distributes the image data and transmits it through the first internal links and the second internal links, a first MUX continuously transfers the image data received through the first channel links to first channel groups and a second MUX continuously transfers the image data received through the second channel links to second channel groups.

* * * * *